US010494945B2

(12) United States Patent
Grande et al.

(10) Patent No.: US 10,494,945 B2
(45) Date of Patent: Dec. 3, 2019

(54) OUTER AIRSEAL ABRADABLE RUB STRIP

(71) Applicant: United Technologies Corporation, Farmington, CT (US)

(72) Inventors: Daniel Anthony Grande, West Hartford, CT (US); Agnieszka M. Wusatowska-Sarnek, Mansfield Center, CT (US); Thomas D. Kasprow, Glastonbury, CT (US); David Ulrich Furrer, Marlborough, CT (US); Sergei F. Burlatsky, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 638 days.

(21) Appl. No.: 15/137,524

(22) Filed: Apr. 25, 2016

(65) Prior Publication Data

US 2017/0306783 A1 Oct. 26, 2017

(51) Int. Cl.

| | |
|---|---|
| ***F01D 11/12*** | (2006.01) |
| ***F01D 25/00*** | (2006.01) |
| ***C23C 4/134*** | (2016.01) |
| ***C23C 4/126*** | (2016.01) |
| ***C23C 4/131*** | (2016.01) |
| ***C23C 4/073*** | (2016.01) |

(52) U.S. Cl.

CPC ..... *F01D 11/122* (2013.01); *C23C 4/073* (2016.01); *C23C 4/126* (2016.01); *C23C 4/131* (2016.01);

(Continued)

(58) Field of Classification Search

CPC ..... F01D 11/122; F01D 11/125; F01D 11/08; F01D 11/12; F01D 11/127; F01D 25/005; F05D 2300/6032; F05D 2230/90

See application file for complete search history.

(56) References Cited

U.S. PATENT DOCUMENTS 5,976,695 A * 11/1999 Hajmrle ..... C22C 32/0089 277/941

8,777,562 B2 7/2014 Strock et al.

(Continued)

FOREIGN PATENT DOCUMENTS

| | | |
|---|---|---|
| EP | 0187612 A2 | 7/1986 |
| EP | 2270258 A2 | 1/2011 |
| GB | 2121884 A | 1/1984 |

OTHER PUBLICATIONS

E. Irissou et al., "Tribological Characterization of Plasma-Sprayed CoNiCrAlY—BN Abradable Coatings", Journal of Thermal Spray Technology, vol. 23, Issue 1-2, pp. 252-261, Jan. 2014, ASM International, Materials Park, Ohio.

Material Product Data Sheet, CoNiCrAlY—BN/Polyester Abradable Thermal Spray Powders, Aug. 2014, Oerlikon Metco, Westbury, New York.

(Continued)

*Primary Examiner* — Dwayne J White
*Assistant Examiner* — Danielle M. Christensen
(74) *Attorney, Agent, or Firm* — Bachman & LaPointe, P.C.

(57) ABSTRACT

A blade outer airseal has a body comprising: an inner diameter (ID) surface; an outer diameter (OD) surface; a leading end; and a trailing end. The airseal body has a metallic substrate and a coating system atop the substrate along at least a portion of the inner diameter surface. At least over a first area of the inner diameter surface, the coating system comprises an abradable layer system comprising a plurality of layers including a relatively erosion-resistant first layer atop a relatively abradable second layer.

20 Claims, 5 Drawing Sheets

(52) U.S. Cl.
CPC ..... *C23C 4/134* (2016.01); *F01D 11/125* (2013.01); *F01D 25/005* (2013.01); *F05D 2220/32* (2013.01); *F05D 2230/30* (2013.01); *F05D 2230/311* (2013.01); *F05D 2230/312* (2013.01); *F05D 2230/60* (2013.01); *F05D 2230/90* (2013.01); *F05D 2300/175* (2013.01); *F05D 2300/177* (2013.01); *F05D 2300/2282* (2013.01); *F05D 2300/514* (2013.01); *F05D 2300/6032* (2013.01); *F05D 2300/615* (2013.01)

(56) References Cited

U.S. PATENT DOCUMENTS 8,801,373 B2 * 8/2014 Kojima ..... C22C 19/00 277/415
8,876,466 B2 * 11/2014 Pattinson ..... B23K 26/206 415/116

OTHER PUBLICATIONS

Material Product Data Sheet, Nickel Chromium Aluminum/Bentonite Abradable Powders, Aug. 2014, Oerlikon Metco, Westbury, New York.
U.S. Appl. No. 14/947,494, of Leslie et al., entitled "Outer Airseal for Gas Turbine Engine", filed Nov. 20, 2015.
European Search Report dated Aug. 9, 2017 for European Patent Application No. 17167769.3.
European Office Action dated Apr. 5, 2019, for European Patent Application No. 17167769.3.

* cited by examiner

OUTER AIRSEAL ABRADABLE RUB STRIP

BACKGROUND

This disclosure relates to a gas turbine engine, and more particularly to gaspath leakage seals for gas turbine engines.

Gas turbine engines, such as those used to power modern commercial and military aircraft, generally include one or more compressor sections to pressurize an airflow, a combustor section for burning hydrocarbon fuel in the presence of the pressurized air, and one or more turbine sections to extract energy from the resultant combustion gases. The airflow flows along a gaspath through the gas turbine engine.

The gas turbine engine includes a plurality of rotors arranged along an axis of rotation of the gas turbine engine. The rotors are positioned in a case, with the rotors and case having designed clearances between the case and tips of rotor blades of the rotors. It is desired to maintain the clearances within a selected range during operation of the gas turbine engine as deviation from the selected range can have a negative effect on gas turbine engine performance. For each blade stage, the case typically includes an outer airseal located in the case immediately outboard (radially) of the blade tips to aid in maintaining the clearances within the selected range.

Within the compressor section(s), temperature typically progressively increases from upstream to downstream along the gaspath. Particularly, in relatively downstream stages, heating of the airseals becomes a problem. U.S. patent application Ser. No. 14/947,494, of Leslie et al., entitled "Outer Airseal for Gas Turbine Engine", and filed Nov. 20, 2015 ('494 application), the disclosure of which is incorporated by reference in its entirety herein as if set forth at length, discusses several problems associated with heat transfer to outer airseals and several solutions.

The airseal typically has an abradable coating along its inner diameter (ID) surface. In relatively downstream stages of the compressor where the blades have nickel-based superalloy substrates, the abradable coating material may be applied to a bondcoat along the metallic substrate of the outer airseal. For relatively upstream sections where the compressor blades comprise titanium-based substrates (a potential source of fire) systems have been proposed with a fire-resistant thermal barrier layer intervening between the bondcoat and the abradable material. An example of such a coating is found in U.S. Pat. No. 8,777,562 of Strock et al., issued Jul. 15, 2014 and entitled "Blade Air Seal with Integral Barrier".

SUMMARY

One aspect of the disclosure involves a blade outer airseal having a body. The body comprises: an inner diameter (ID) surface; an outer diameter (OD) surface; a leading end; and a trailing end. The airseal body has a metallic substrate and a coating system atop the substrate along at least a portion of the inner diameter surface. At least over a first area of the inner diameter surface, the coating system comprises an abradable layer system comprising a plurality of layers including a relatively erosion-resistant first layer atop a relatively abradable second layer.

A further embodiment may additionally and/or alternatively include the plurality of layers having a metallic matrix.

A further embodiment may additionally and/or alternatively include the metallic matrix comprising an MCrAlY in the second layer and an MCrAlY or a Ni-based alloy in the first layer.

A further embodiment may additionally and/or alternatively include the metallic matrix comprising, by weight, 50% combined cobalt and nickel.

A further embodiment may additionally and/or alternatively include the plurality of layers further comprising: a third layer below and more erosion-resistant than the second layer; and a fourth layer below and less erosion resistant than the third layer.

A further embodiment may additionally and/or alternatively include the first and third layers being essentially the same and the second and fourth layers being essentially the same.

A further embodiment may additionally and/or alternatively include: the first and third layers being each between 0.020 mm and 0.15 mm thick; the second layer being between 0.040 mm and 2.0 mm thick; and the fourth layer being at least 2.0 mm thick.

A further embodiment may additionally and/or alternatively include the first and third layers being thinner than the second layer and the second layer being thinner than the fourth layer.

A further embodiment may additionally and/or alternatively include the first layer having at most 10% porosity and the second layer having at least 40% porosity.

A further embodiment may additionally and/or alternatively include the first layer having a bentonite filler and the second layer having a boron nitride filler.

A further embodiment may additionally and/or alternatively include the second layer comprising a boron nitride and the first layer comprising a lower, if any, weight content of boron nitride than does the second layer.

A further embodiment may additionally and/or alternatively include the first layer and the second layer comprising metallic matrix compositions differing by no more than 1.0 weight percent of any component.

A further embodiment may additionally and/or alternatively include one or more of: the coating system having a bondcoat between the abradable layers and the substrate; and the substrate being a nickel-based superalloy.

Another aspect of the disclosure involves a method for manufacturing the blade outer airseal, the method comprising thermal spray of the first layer and the second layer.

A further embodiment may additionally and/or alternatively include the thermal spray comprising spraying matrix for the first layer and the second layer from the same source while varying one or more non-matrix components.

A further embodiment may additionally and/or alternatively include the varying the one or more non-matrix components comprising using less of the one or more non-matrix components when spraying the first layer than when spraying the second layer.

Another aspect of the disclosure involves a method for using the blade outer airseal, the method comprising: installing the blade outer airseal on a turbine engine; and running the turbine engine so that blade tips rub the abradable coating.

A further embodiment may additionally and/or alternatively include the rub causing the blade tips to locally fully penetrate the first layer.

A further embodiment may additionally and/or alternatively include the plurality of layers further comprising: a third layer below and more erosion-resistant than the second layer; and a fourth layer below and less erosion resistant than the third layer; the rub does not cause the blade tips to penetrate the third layer.

A further embodiment may additionally and/or alternatively include a damage event causing imbalance so as to produce further rub which causes the blade tips to penetrate the third layer but not reach the substrate.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
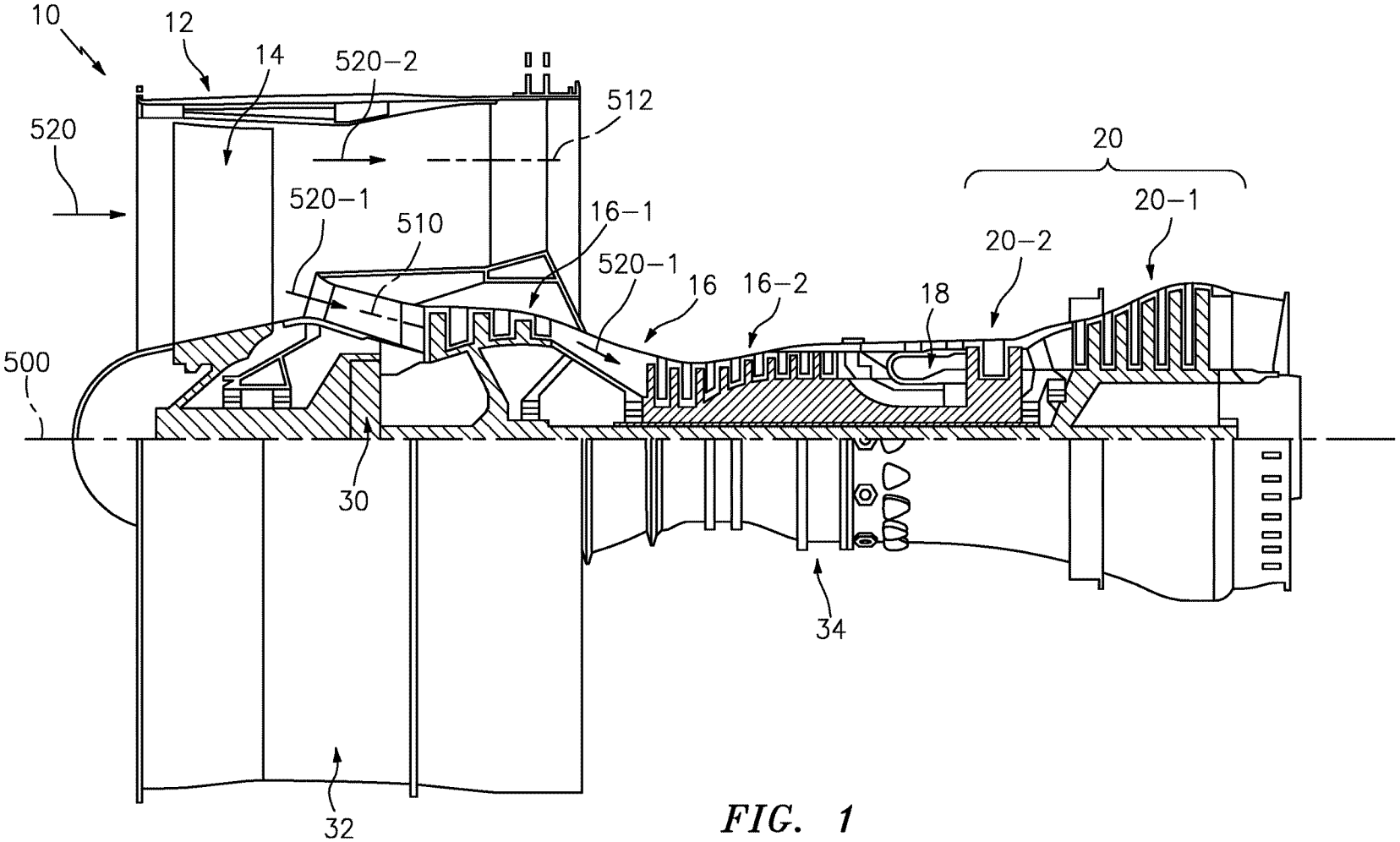
FIG. 1 is a schematic axial half cross-sectional view of an embodiment of a gas turbine engine.

FIG. 1 is a schematic illustration of a gas turbine engine 10. The illustrated engine is a turbofan used to produce propulsive thrust in aerospace applications. Broadly, relevant gas turbine engines may also include turbojets, turboprops, industrial gas turbines (IGT), and the like. For purposes of illustration, outer aerodynamic cases are not shown. The gas turbine engine has a central longitudinal axis 500. The gas turbine engine generally has a fan section 12 through which an inlet flow 520 of ambient air is propelled by a fan 14, a compressor 16 for pressurizing the air 520-1 received from the fan 14, and a combustor 18 wherein the compressed air is mixed with fuel and ignited for generating combustion gases. The inlet flow 520 splits into a first or core portion 520-1 flowing along the gaspath (core flowpath) 510 and a bypass portion 520-2 flowing along a bypass flowpath 512. The illustrated engine 10 and gross features of its airseals (discussed below) are based on a particular configuration shown in the aforementioned '494 application. Nevertheless, the teachings herein may be applied to other general engine configurations and other general airseal configurations.

The gas turbine engine 10 further comprises a turbine 20 for extracting energy from the combustion gases. Fuel is injected into the combustor 18 of the gas turbine engine 10 for mixing with the compressed air from the compressor 16 and ignition of the resultant mixture. The fan 14, compressor 16, combustor 18, and turbine 20 are typically all concentric about a common central longitudinal axis 500 of the gas turbine engine 10.

Depending upon the implementation, the compressor and turbine may each contain multiple sections. Each section includes one or more stages of rotor blades interspersed with one or more stages of stator vanes. The exemplary configuration has two compressor sections and two turbine sections. From upstream to downstream along the gaspath 510, these include a low pressure compressor section (LPC) 16-1, a high pressure compressor section (HPC) 16-2, a high pressure turbine section (HPT) 20-2, and a low pressure turbine section (LPT) 20-1. The exemplary rotors of the LPC and LPT are formed to rotate as a first unit or low pressure spool with the LPT driving the LPC. Similarly, the HPT and HPC rotors are arranged as a high pressure spool. The fan may be driven by the low pressure spool either directly or via a reduction gearbox 30. Other configurations are, however, known. Whereas illustrated in the context of compressors 16, one skilled in the art will readily appreciate that the present disclosure may be utilized with respect to turbines (e.g., an LPT where temperatures are relatively low).

Figure 2:
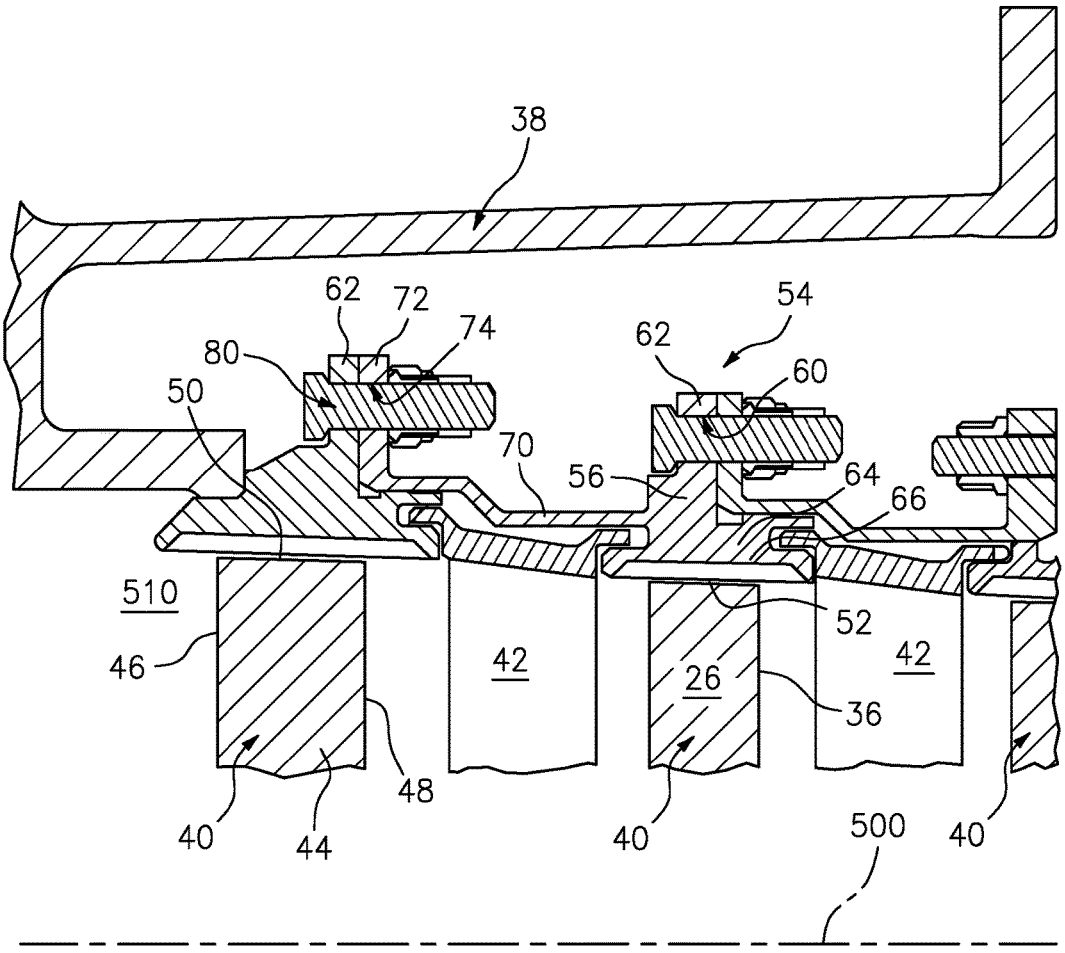
FIG. 2 is a schematic axial cross-sectional view of an embodiment of a compressor of the gas turbine engine.

The exemplary engine comprises a fan case 32 and a core case 34. The core case has sections along the corresponding sections of the engine core. FIG. 2 shows an HPC case section 38 of the core case 34 along the HPC.

FIG. 2 schematically shows several stages of blades 40 of the HPC rotor. Interspersed with the blades are stages of stator vanes 42. Each blade has an airfoil 44 having a leading edge 46, a trailing edge 48, a pressure side (not shown) and a suction side (not shown) and extends from an inboard end to an outboard tip 50. The tip 50 is in close facing proximity to an inner diameter (ID) surface 52 of an outer airseal 54. Each exemplary outer airseal 54 includes a metallic substrate 56 and an abradable coating system (or rub strip) 58 (FIG. 2A) forming the ID surface 52 along an ID surface of the substrate. Exemplary substrate materials will depend on the particular stage in the engine. For downstream compressor stages (e.g., of the HPC) and turbine stages, typical substrate materials are nickel-based superalloys. Blade substrates in thse stages may also be nickel-based superalloys.

The exemplary outer airseal 54 is formed as a generally full annulus (e.g., locally interrupted by mounting features such as a circumferential array of holes 60 in a radially outwardly extending flange 62). In cross-section, the exemplary outer airseals 54 comprise an inboard body or band 64 comprising a body or band 66 of the substrate and the rub strip 58 inboard thereof. The flange 62 extends radially outward from the band 66. For mounting the exemplary airseals, at a forward end of the flange 62, an axial collar portion 70 extends forwardly to terminate in a radially outward extending flange 72. The flange 72 has mounting holes 74 complementary to mounting holes of an adjacent mating flange. FIG. 2 shows several airseal stages associated with respective blade stages. Each flange 72 may mate to a flange 62 of the next forward airseal and be secured thereto via fasteners (e.g., threaded fasteners) 80.

Figure 2A:
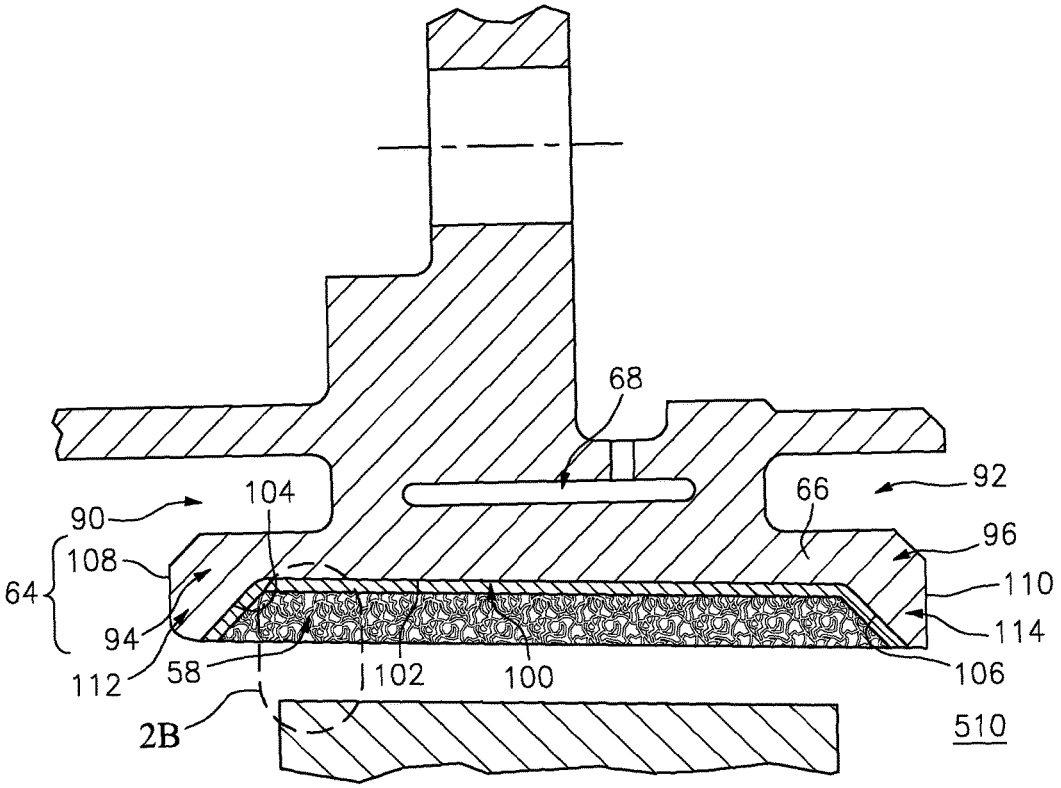
FIG. 2A is a schematic axial cross-sectional view of an embodiment of an outer airseal of the compressor of the a gas turbine engine at detail 2A of FIG. 2.

FIG. 2A further shows respective fore and aft channels 90 and 92 outboard of corresponding cantilevered portions 94 and 96 of the substrate band 66 for capturing associated flanges of adjacent stages of stator segments.

As is discussed in aforementioned '494 application, heat transfer to the flanges 62 and 72 is a source of problems. Steps that have been undertaken to address this include: making the flange 62 appropriately massive; and adding cooling features 68 such as those in the '494 application. The massiveness of the flange 62 functions in several ways. First, for a given amount of heat transfer to the band 66, and thus from the band to the flange 62, the temperature increase experienced by the flange will be smaller for more massive flanges. Second, a more massive flange 62 can more easily mechanically resist expansion caused by heating of the band 66 due to greater strength of the more massive flange. The rub strip 58 may be used in conjunction with or without features such as those shown in the '494 application.

From first operation, the blade tips will cut into the rub strip. It is desirable that the rub strip be abradable to be easily cut by the blade tip to quickly run-in. However, highly abradable material is subject to erosion. Erosion allows gas to blow by the tips, thereby reducing engine efficiency. As is discussed below, a layering of the rub strip allows the blade tip to quickly cut through a thin relatively non-abradable but erosion-resistant layer while then running-in in a relatively abradable but non-erosion resistant layer.

The exemplary rub strip 58 (FIG. 2A) is located in an inwardly (radially) open annular channel 100 or well in the substrate band portion 66. The channel has a surface comprising a base surface 102 and respective fore and aft surfaces 104 and 106.

The band 66 extends from a forward rim 108 to an aft rim 110 and has forwardmost and aftmost portions 112 and 114 respectively forward of and behind the channel 100.

The rub strip 58 may be formed with multiple layers. A base layer 124 (FIG. 2B) may be a bondcoat atop an inner diameter (ID) surface portion of the substrate band formed by the channel surfaces (102, 104, 106). An abradable layer system 128 is at least locally atop the bondcoat or otherwise positioned. The abradable layer system 128 may represent modification of any appropriate prior art or future abradable layer composition but featuring sublayering discussed below.

The exemplary bondcoat 124 includes a base layer 130 and a thermally grown oxide (TGO) layer 132. The base layer and TGO layer may originally be deposited as a single precursor layer. There may be diffusion with the substrate. The TGO layer may reflect oxidation of original material of the precursor. Exemplary base layer thicknesses are 10-400 micrometers, more narrowly 20-200 micrometers. Exemplary TGO layer thicknesses are 0.05-1 micrometers, more narrowly 0.1-0.5 micrometers. Alternative bondcoats include diffusion aluminides.

An exemplary coating process includes preparing the substrate (e.g., by cleaning and surface treating). A precursor of the bondcoat is applied. An exemplary application is of an MCrAlY, more particularly a NiCoCrAlY material. An exemplary MCrAlY is Ni 23Co 17Cr 12Al0.5Y. An exemplary application is via a spray (e.g., a thermal spray) from a powder source. Exemplary application is via air plasma spray (APS). Alternative methods include a high-velocity oxy-fuel (HVOF) process, a high-velocity air-fuel (HVAF) process, a low pressure plasma spray (LPPS) process, or a wire-arc process.

An exemplary application is to a thickness of 0.003-0.010 inch, (76-254 micrometers) more broadly 0.001-0.015 inch (25-381 micrometers).

After the application, the precursor may be diffused. An exemplary diffusion is via heating (e.g., to at least 1900° F. (1038° C.) for a duration of at least 4 hours) in vacuum or nonreactive (e.g., argon) atmosphere. The exemplary diffusion may create a metallurgical bond between the bondcoat and the substrate. Alternatively diffusion steps may occur after applying the TBC, if at all.

After application of the bondcoat precursor, if any, the substrate may be transferred to a coating apparatus for applying the abradable layer system 128. An exemplary application is via a spray (e.g., a thermal spray) from a powder source. Exemplary application is via air plasma spray (APS). Alternative methods include a high-velocity oxy-fuel (HVOF) process, a high-velocity air-fuel (HVOF) process, a low pressure plasma spray (LPPS) process, or a wire-arc process.

An exemplary abradable layer system 128 is a metal matrix composite. An exemplary metal matrix composite comprises the metal (alloy) matrix 140, a solid lubricant 142, and porosity 144.

Figure 2B:
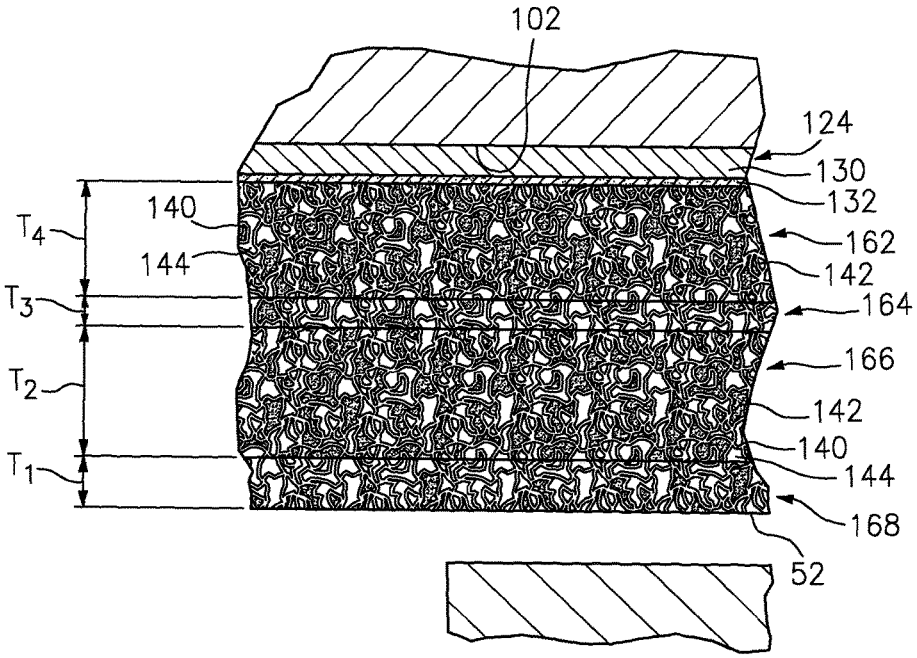
FIG. 2B is a coating cross section at detail 2B of FIG. 2A in a pre-run-in condition.
Figure 2C:
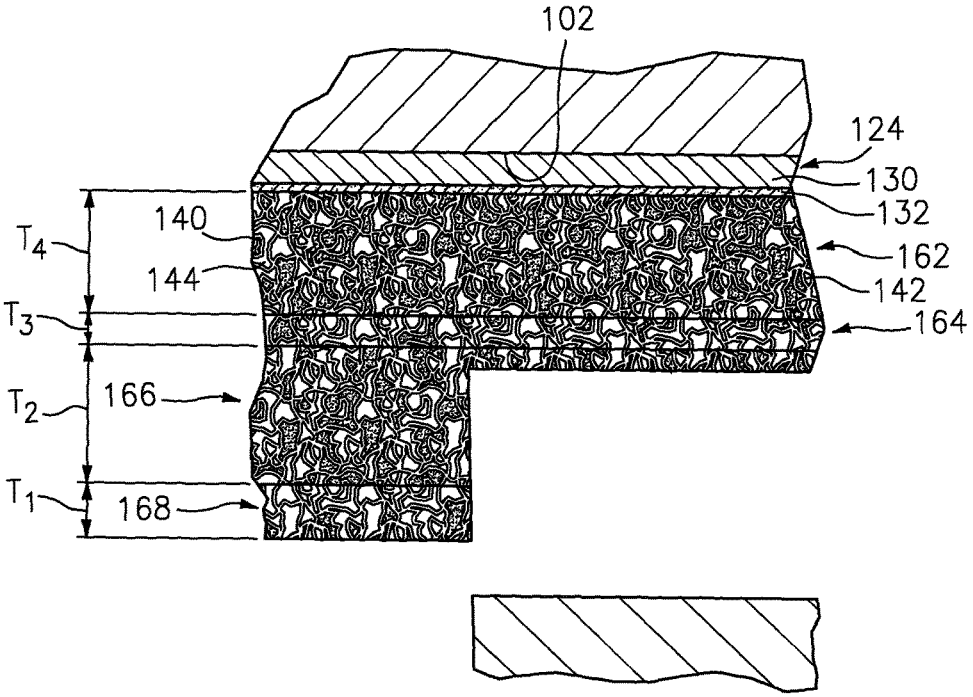
FIG. 2C is a coating cross section at detail 2B of FIG. 2A in a run-in condition.

The exemplary abradable layer system comprises a plurality of layers between the gaspath surface and the bondcoat. FIG. 2B shows an exemplary four layers with a top layer 168 (thickness shown as $T_1$), an underlayer 166 (thickness shown as $T_2$), beneath that, an underlayer 164 (thickness shown as $T_3$), beneath that, and an underlayer 162 (thickness shown as $T_4$), beneath that. The top layer 168 is relatively erosion-resistant as noted above; whereas the underlayer 166 is relatively abradable. These layers comprise a ceramic (e.g., YSZ) and/or a metal matrix, porosity, a solid lubricant. Exemplary compositions are MCrAlY-based.

One group of examples alternate the layers so that the layers 168 and 164 are relatively erosion resistant of same or similar composition to each other and layers 166 and 162 are relatively abradable of same or similar composition to each other. An exemplary abradable composition is an MCrAlY matrix and boron nitride solid lubricant. An exemplary erosion-resistant composition has less or no solid lubricant.

The exemplary four-layer system accommodates both a both a normal run-in situation and an abnormal situation (e.g., engine damage due to foreign object ingestion such as bird strike). FIG. 2B shows an as-sprayed condition. If the engine is run in a normal operating cycle, in at least a portion of that cycle, the blade tips will rub the coating. This will locally fully penetrate the top erosion-resistant layer 168 with the blade penetrating into the abradable layer 166. This rub/run-in leaves intact portions of the top layer 168 immediately ahead/upstream of and behind/downstream of the blade-swept band (the portion of the airseal longitudinally between the forwardmost and aftmost extremes of the blade tip).

Thickness of the layer 168 may be small enough to be easily worn through by the blades, but large enough to resist erosion over the service life of the seal.

Figure 2D:
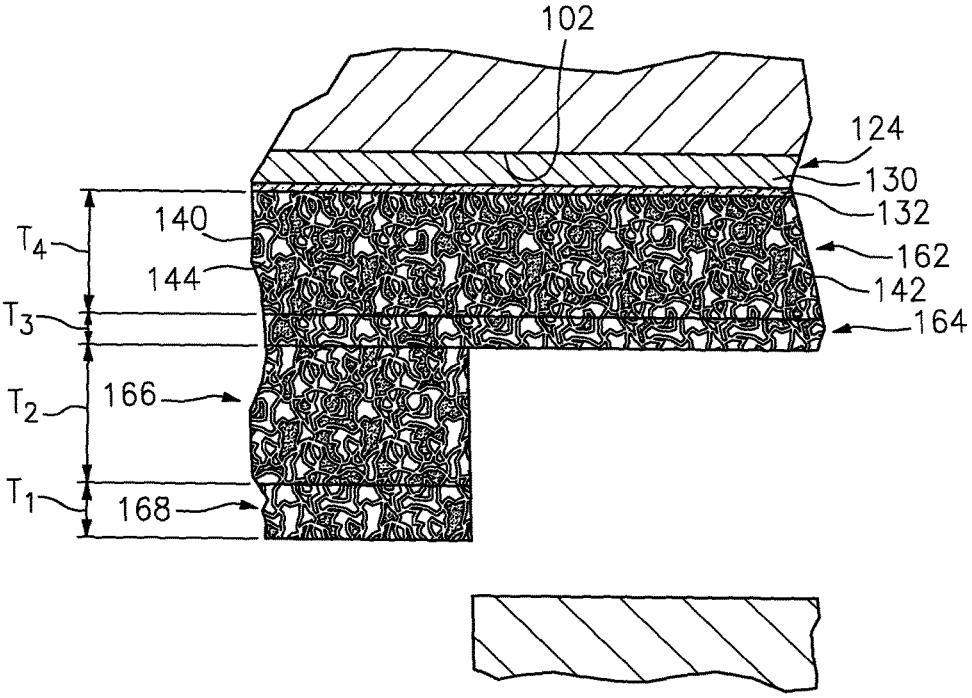
FIG. 2D is a coating cross section at detail 2B of FIG. 2A in a run-in and eroded condition.

The thickness of the layer 166 may be selected to be large enough to accommodate the normal run-in/rub. The normal run-in/rub may leave a partial local thickness of the layer 166 along the blade-swept band. However, this exposed material of the layer 166 may erode from gas and particulate exposure and may thus erode down to the layer 164 (FIG. 2D). This erosion creates leakage and inefficiency. Thus, the thickness of the layer 166 may be kept low enough to limit the amount of post-run-in erosion that can take place.

Figure 2E:
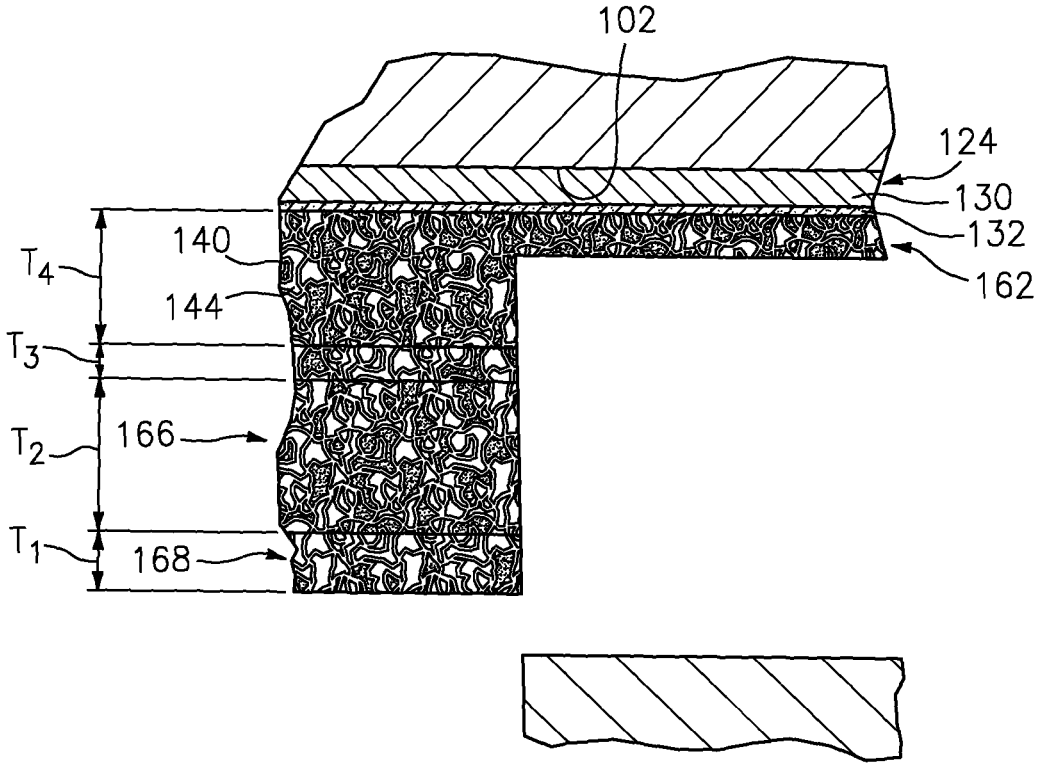
FIG. 2E is a coating cross section at detail 2B of FIG. 2A in a post-imbalance condition.

However, an abnormal condition such as an engine imbalance due to foreign object ingestion may cause greater blade excursion. FIG. 2E shows penetration through the layer 164 due to such an event. Accordingly, the layer 162 may be selected to be thick enough to accommodate the additional excursion due to the anticipated imbalance. In an example below, the layer 162 is thus much thicker than the layer 166 due to the much greater size of a damage excursion vs. normal radial run-in.

TABLE I

| Layer | Example Layer Thickness (inches (mm)) | | |
|---|---|---|---|
| Ref. | Min. | Max. | Nominal/Average |
| 162 | 0.115 (2.92) | 0.155 (3.94) | 0.135 (3.43) |
| 164 | 0.001 (0.025) | 0.003 (0.076) | 0.002 (0.051) |
| 166 | 0.0025 (0.064) | 0.0045 (0.11) | 0.035 (0.89) |
| 168 | 0.001 (0.025) | 0.003 (0.076) | 0.002 (0.051) |

The min. and max. for this example may serve as min. and max. values for an average or for a reference area of the coating. Averages may be taken as mean, median, or modal values. An exemplary reference area is the ID face overall. An alternative reference area may be the area in the as-deposited condition that will correspond to the blade-swept area. Another alternative area may be an area adjacent the blade-swept area (e.g., areas ahead of and/or aft of the blade-swept area; either to the rims or over a lesser span such).

Particular thicknesses chosen will depend on the particular engine involved and particular location on that engines because different thermal and mechanical properties will attend such differences. Exemplary thicknesses of the abradable layer 166 is more broadly 0.040 mm to 2.0 mm. Exemplary thicknesses of the abradable layer 162 is more broadly 2.0 mm to 6.0 mm. Exemplary thicknesses of the erosion-resistant layers may more broadly be 0.020 mm to 0.15 mm.

One specific group of examples spray the relatively abradable layer(s) using Metco 2042 (trademark of Oerlikon Metco, Winterthur Switzerland) CoNiCrAlY matrix and boron nitride lubricant with nominal weight percentages 29 Co, 24 Ni, 16 Cr, 6 Al, 0.3 Y, 7 BN, 14 polyester porosity former, 3 organic solids (serving as binder to hold the powders of the other components in agglomerates). The erosion-resistant layers may have a similar CoNiCrAlY but without the hBN, organics, and polyester. (e.g., with nominal weight percentages of 39 Co, 32 Ni, 21 Cr, 8 Al, and 0.4 Y). This would result in abradable layers having weight % composition of 34 Co, 29 Ni, 19 Cr, 7 Al, 0.4 Y, 8 hBN, and 4 organic solids (if the solids do not burn or volatize off as does the polyester; the particular organics and the particular treatment or runnin temperatures will dictate whether they remain). The erosion-resistant layer would have a weight % composition of 39 Co, 32 Ni, 21 Cr, 8 Al, and 0.4 Y. The abradable layer would have high porosity (e.g., at least 40% or at least 50% or 40% to 75% or 50% to 70% or 50% to 60%). The erosion-resistant layer could be much less porous and even essentially fully-dense (e.g., 10% or less porosity or 5% or less). As is discussed below, the gases used in the spray process can account for inter-splat porosity at such low levels even without any fugitive porosity former.

In a further variation having the same resulting coating chemistry, instead of the preblended Metco 2042, the same matrix powder may be sprayed from one source of a two-source gun during spray of both layer types while a blend of the hBN, organics, and polyester is sprayed from the second source only during the spraying of the abradable layers.

In variations, two distinct MCrAlYs may be used and/or different distinct nonzero amounts of solid lubricant. One specific example is based on the Metco 2042 above. The spraying of the erosion-resistant layers may include the hBN and organic solids but not the polyester. For example, the metallic matrix, hBN and organics may be in one source and the polyester in the other source. During spraying of the abradable layer, the volume flow rates from the two sources may be selected to give a net flow comparable to the Metco 2042. Or the polyester flow may be changed such as to be more polyester-rich than Metco 2042. The polyester flow may be shut off during spraying of the erosion-resistant layers. Both layers would have the same composition (e.g., nominal weight percentages 34 Co, 29 Ni, 19 Cr, 7 Al, 0.4 Y, 8 hBN, and 4 organic solids), but vary in porosity in the same way as noted above.

Another specific example sprays the relatively abradable layer(s) using Metco 2042 CoNiCrAlY matrix and boron nitride lubricant with nominal weight percentages 29 Co, 24 Ni, 16 Cr, 6 Al, 0.3 Y, 7 BN, 14 polyester porosity former, 3 organic solids. The relatively erosion-resistant layer(s) are sprayed from Metco 2043 CoNiCrAlY matrix and boron nitride lubricant with nominal weight percentages 30 Co, 25 Ni, 16 Cr, 6 Al, 0.3 Y, 4 BN, 15 polyester porosity former, 3 organic solids. Using a two-source gun, these respective feedstocks could be in the two source reservoirs and the gun may be switched between them to alternate layers.

Another specific example sprays the relatively abradable layer(s) using Metco 2042 and the erosion-resistant layers with Metco 314 NS (nominal weight percentages 71 Ni, 4 Cr, 4Al, 21 bentonite). Porosities would be similar to those noted above. The heavily nickel-based matrix alloy of Metco 314 NS is believed to result in a less alloyed metallic phase that is likely more ductile. Ductile materials have better erosion resistance when erosion particle impingement occurs at or near 90° to the abradable surface. Such impingement may be particularly relevant with the layer 164 due to aeroforces from the blades. The bentonite adds further structural weakness to allow cutting by the blade. Bentonite is a soft phase that is largely non-structural and easily abraded away. Therefore it is used as a filler in abradable coatings to ensure that the coatings remain abradable.

Other variations involve the fugitive former (e.g., other than polyester may be used) and the solid lubricant. Alternative solid lubricants include graphite.

In a further variation, the layers 168 and 164 may have differing compositions respectively optimized for differing erosion conditions. The layer 168 may be optimized for flow conditions away from the blade-swept band (if the portion along the blade-swept band is expected to be cut away by the blades). The layer 164 may be optimized for exposure to airflow along the blade-swept band (because the portions away therefrom would be protected by the layers 168 and 166).

In a further variation manufacture, a single source material mixture is used for the layers and the property variation is achieved by varying spray parameters. For example, hydrogen gas concentration may be varied. Use of more hydrogen will lead to less inter-splat oxide, and thus stronger inter-splat adhesion, greater erosion resistance and lesser abradability. Thus a greater hydrogen flow rate may be used in the top layer 168 than in the adjacent underlayer 166.

One characteristic difference between the two layer types is horizontal force response. During rub rig testing, an abradable layer of coating will typically show a horizontal force response of 3-10 newtons, whereas an erosion resistant layer will show a horizontal force response of 13-20 newtons. Force measurement is indicative of abradablity and this difference indicates that the abradable layer is approximately 2× to 4× more abradable than the erosion resistant layer. See, E. Irissou, A. Dadouche, and R. S. Lima, "Tribological Characterization of Plasma-Sprayed CoNiCrAlY-BN Abradable Coatings", Journal of Thermal Spray Technology, Volume 23, Issue 1-2, pp. 252-261, January, 2014, ASM International, Materials Park, Ohio.

Another characteristic difference is erosion rate. During erosion testing, an abradable layer of coating will typically show a linear erosion rate of 0.040-0.080 inches/kg, whereas an erosion-resistant layer will show a linear erosion rate of 0.010-0.020 inches/kg. This difference indicates that the erosion-resistant layer of coating is approximately 2× to 8× more erosion resistant than the abradable layer of coating (as measured by linear erosion rate during standard erosion testing). Erosion rate is calculated by spraying an AlOx erodent of known weight at the abradable material. The depth of the erosion crater is then measured. By performing this calculation multiple times, at various erosion weights, a "linear erosion rate" can be calculated which is simply inches of abradable loss per kilogram of erodent impacted against the abradable.

The exemplary layers 168, 166, 164, and 162 are substantially devoid of ceramic phases (e.g., GSZ or YSZ) as are used in thermal barrier coatings and some abrasive or abradable coatings (e.g., no more than 5.0% ceramic by weight or no more than 1.0%). Ceramic-containing abradables are relatively abrasive and often require blade tip treatment (e.g., cBN) rather than allowing the blade substrate to be exposed to the abradable.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

The invention claimed is:

1. A blade outer airseal having:
- a body comprising:
  - an inner diameter (ID) surface;
  - an outer diameter (OD) surface;
  - a leading end;
  - a trailing end;
  - a metallic substrate; and
  - a coating system atop the substrate along at least a portion of the inner diameter surface, wherein:
- at least over a first area of the inner diameter surface, the coating system comprises an abradable layer system comprising a plurality of layers including a first layer atop a second layer;
- the first layer is relatively erosion-resistant relative to the second layer;
- the second layer is relatively abradable relative to the first layer;
- the first layer has at most 10% porosity;
- the second layer has at least 40% porosity;
- the second layer comprises a boron nitride; and
- the first layer comprises a lower, if any, weight content of boron nitride than does the second layer.

2. The blade outer airseal of claim 1 wherein the plurality of layers have a metallic matrix.

3. The blade outer airseal of claim 2 wherein the metallic matrix comprises an MCrAlY in the second layer and an MCrAlY or a Ni-based alloy in the first layer.

4. The blade outer airseal of claim 2 wherein the metallic matrix comprises, by weight:
- ≥50% combined cobalt and nickel.

5. The blade outer airseal of claim 1 wherein the plurality of layers further comprises:
- a third layer below and more erosion-resistant than the second layer; and
- a fourth layer below and less erosion resistant than the third layer.

6. The blade outer airseal of claim 5 wherein:
- the first and third layers are essentially the same; and
- the second and fourth layers are essentially the same.

7. The blade outer airseal of claim 5 wherein:
- the first and third layers are each between 0.020 mm and 0.15 mm thick;
- the second layer is between 0.040 mm and 2.0 mm thick; and
- the fourth layer is at least 2.0 mm thick.

8. The blade outer airseal of claim 7 wherein:
- the first and third layers are thinner than the second layer; and
- the second layer is thinner than the fourth layer.

9. The blade outer airseal of claim 1 wherein:
- the first layer has a bentonite filler.

10. The blade outer airseal of claim 1 wherein the first layer and the second layer comprise metallic matrix compositions differing by no more than 1.0 weight percent of any component.

11. The blade outer airseal of claim 1 wherein one or more of:
- the coating system has a bondcoat between the abradable layer and the substrate; and
- the substrate is a nickel-based superalloy.

12. A method for manufacturing the blade outer airseal of claim 1, the method comprising:
- thermal spray of the first layer and the second layer.

13. The method of claim 12 wherein:
- the thermal spray comprises spraying matrix for the first layer and the second layer from the same source while varying one or more non-matrix components.

14. The method of claim 13 wherein:
- the varying the one or more non-matrix components comprises using less of the one or more non-matrix components when spraying the first layer than when spraying the second layer.

15. A method for using the blade outer airseal of claim 1, the method comprising:
- installing the blade outer airseal on a turbine engine; and
- running the turbine engine so that blade tips rub the abradable coating.

16. The method of claim 15 wherein the rub causes the blade tips to locally fully penetrate the first layer.

17. The method of claim 16 wherein:
- the plurality of layers further comprises:
  - a third layer below and more erosion-resistant than the second layer; and
  - a fourth layer below and less erosion resistant than the third layer;
- the rub does not cause the blade tips to penetrate the third layer.

18. The method of claim 17 further comprising:

a damage event causing imbalance so as to produce further rub which causes the blade tips to penetrate the third layer but not reach the substrate.

19. A blade outer airseal having:

a body comprising:

an inner diameter (ID) surface;

an outer diameter (OD) surface;

a leading end;

a trailing end;

a metallic substrate; and a coating system atop the substrate along at least a portion of the inner diameter surface, wherein:

at least over a first area of the inner diameter surface, the coating system comprises an abradable layer system comprising a plurality of layers including a first layer atop a second layer;

the first layer is relatively erosion-resistant relative to the second layer;

the second layer is relatively abradable relative to the first layer;

the first layer has at most 10% porosity;

the second layer has at least 40% porosity;

the first layer has a bentonite filler; and the second layer has a boron nitride filler.

20. The blade outer airseal of claim 19 wherein the plurality of layers have a metallic matrix.

* * * * *